US010538108B2

(12) United States Patent
Yokota

(10) Patent No.: US 10,538,108 B2
(45) Date of Patent: Jan. 21, 2020

(54) LIQUID DROPLET DISCHARGING APPARATUS, AND PATTERN READING METHOD OF LIQUID DROPLET DISCHARGING APPARATUS

(71) Applicant: SEIKO EPSON CORPORATION, Tokyo (JP)

(72) Inventor: So Yokota, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/926,695

(22) Filed: Mar. 20, 2018

(65) Prior Publication Data

US 2018/0272746 A1 Sep. 27, 2018

(30) Foreign Application Priority Data

Mar. 23, 2017 (JP) ..... 2017-057139

(51) Int. Cl.
*B41J 2/21* (2006.01)
*B41J 2/15* (2006.01)
*B41J 15/04* (2006.01)

(52) U.S. Cl.
CPC ..... *B41J 2/2142* (2013.01); *B41J 2/15* (2013.01); *B41J 15/04* (2013.01)

(58) Field of Classification Search
CPC ..... B41J 2/2132; B41J 15/04; B41J 19/145; B41J 29/38; B41J 2/2135; B41J 2/2139; B41J 2/2142; B41J 11/42; B41J 2/15
USPC ..... 347/5, 9, 12, 16, 19, 78
See application file for complete search history.

(56) References Cited

U.S. PATENT DOCUMENTS

2010/0085397 A1* 4/2010 Tanaka ..... B41J 2/2146 347/14
2014/0152737 A1* 6/2014 Okada ..... B41J 29/38 347/19
2016/0089883 A1 3/2016 Yokota

FOREIGN PATENT DOCUMENTS

JP 2016-064622 A 4/2016
JP 2016-182679 A 10/2016

* cited by examiner

*Primary Examiner* — Jannelle M Lebron
(74) *Attorney, Agent, or Firm* — Foley & Lardner LLP

(57) ABSTRACT

A liquid droplet discharging apparatus includes a printing unit that moves a discharging head in a scanning direction and prints a test pattern on a medium by discharging a liquid droplets from nozzles of the discharging head, a transporting unit that intermittently transports the medium in a transporting direction, and a reading unit that reads the test pattern. The printing unit prints the test pattern by overlapping a transportation reference pattern and a transportation deviation pattern, in order to correct at least any one of a transportation amount of the medium being transported by the transporting unit and a discharging position to which the liquid droplets are discharged from the nozzles. The reading unit reads a completed part of the test pattern at the same time as printing the test pattern by the printing unit.

4 Claims, 12 Drawing Sheets

LIQUID DROPLET DISCHARGING APPARATUS, AND PATTERN READING METHOD OF LIQUID DROPLET DISCHARGING APPARATUS

BACKGROUND

1. Technical Field

The present invention relates to a liquid droplet discharging apparatus such as a printer, and a pattern reading method of the liquid droplet discharging apparatus.

2. Related Art

As an example of a liquid droplet discharging apparatus, there is an ink jet printer that performs printing on a recording medium (medium) by discharging ink (liquid droplets) from a recording head (discharging head) which reciprocates in a scanning direction (for example, JP-A-2016-182679). The recording head prints a test pattern by deviating a position to which ink is discharged on a forward passage and a returning passage, and the ink jet printer sets a correction value for correcting a position to which the ink is discharged based on a deviation amount of the test pattern.

Such an ink jet printer is provided with a plurality of detecting units which detects different colors, and after the test pattern is printed, the plurality of detecting units detects the printed test pattern. Therefore, in the ink jet printer, it takes time to complete detection after printing the test pattern.

Such a problem is not limited to the ink jet printer, and is generally common to a liquid droplet discharging apparatus, and a pattern reading method of the liquid droplet discharging apparatus.

SUMMARY

An advantage of some aspects of the invention is to provide a liquid droplet discharging apparatus which is capable of quickly reading a test pattern, and a pattern reading method of the liquid droplet discharging apparatus.

Hereinafter, means of the invention and operation effects thereof will be described.

According to an aspect of the invention, there is provided a liquid droplet discharging apparatus including a printing unit that moves a discharging head including a nozzle row in which a plurality of nozzles discharging liquid droplets is arranged in a scanning direction which is different from a row direction where the nozzles are arranged, and prints a test pattern on a medium by discharging the liquid droplets from the discharging head, a transporting unit that intermittently transports the medium in a transporting direction which is different from the scanning direction, and a reading unit that reads the test pattern, in which the printing unit prints the test pattern by overlapping a reference pattern and a deviation pattern deviated with respect to the reference pattern, in order to correct at least any one of a transportation amount of the medium being intermittently transported by the transporting unit per transportation and a discharging position to which the liquid droplets are discharged from the nozzles, and the reading unit reads a completed part of the test pattern at the same time as printing the test pattern by the printing unit.

According to this configuration, because printing the test pattern by the printing unit and reading the test pattern by the reading unit are performed at the same time, the test pattern can be quickly read faster than a case in which the printing and the reading are performed separately.

In the liquid droplet discharging apparatus, it is preferable that the test pattern include a plurality of correcting patterns of which the reference pattern and the deviation pattern overlap with each other, the transporting unit transports the medium from an upstream side to a downstream side in the transporting direction while the printing unit prints a first correcting pattern and then prints the second correcting pattern, and the reading unit be positioned on the downstream side of the nozzle row in the transporting direction, and read the first correcting pattern at the same time as printing the second correcting pattern by the printing unit.

According to this configuration, the test pattern proceeds to be fixed while being transported to the reading region where the reading unit performs reading. Therefore, since the reading unit reads the fixed test pattern, accuracy of reading is improved more than in a case in which the test pattern after immediately being printed is read.

In the liquid droplet discharging apparatus, it is preferable that the printing unit print the reference pattern by discharging the liquid droplets from a part of an upstream side nozzle positioned on an upstream side in the transporting direction among the nozzles, the printing unit print the deviation pattern by discharging the liquid droplets from a part of a downstream side nozzle positioned on a downstream side in the transporting direction among the nozzles, and a first length from the center of a reading region where the reading unit reads the medium to the center of the downstream side nozzle be an integral multiple of a second length from the center of the upstream side nozzle to the center of the downstream side nozzle in the transporting direction.

According to this configuration, the first length from the center of the reading region where the reading unit performs reading to the center of the downstream side nozzle is an integral multiple of the second length from the center of the upstream side nozzle to the center of the downstream side nozzle. Therefore, in a case in which the medium is transported in accordance with the second length from the center of the upstream side nozzle to the center of the downstream side nozzle, the test pattern can be easily positioned in the reading region.

In the liquid droplet discharging apparatus, it is preferable that the reading unit be capable of changing a position in the transporting direction.

According to this configuration, since the reading unit is capable of changing the position of the transporting direction, for example, even when a transportation amount of the medium is changed, it is possible to easily position the test pattern in the reading region.

According to another aspect of the invention, there is provided a pattern reading method of a liquid droplet discharging apparatus which includes a printing unit that moves a discharging head including a nozzle row in which a plurality of nozzles discharging liquid droplets is arranged in a scanning direction which is different from a row direction where the nozzles are arranged, and prints a test pattern on a medium by discharging the liquid droplets from the discharging head, a transporting unit that intermittently transports the medium in a transporting direction which is different from the scanning direction, and a reading unit that reads the test pattern, the method including causing the printing unit to print the test pattern by overlapping a reference pattern and a deviation pattern deviated with respect to the reference pattern, in order to correct at least any one of a transportation amount of the medium being intermittently transported by the transporting unit per transportation and a discharging position to which the liquid droplets are discharged from the nozzles, and causing the reading unit to read a completed part of the test pattern at the same time as the printing.

According to this configuration, the same effects as those of the liquid droplet discharging apparatus can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid droplet discharging apparatus will be described with reference to drawings. The liquid droplet discharging apparatus is, for example, a large format printer which performs printing (recording) on a long medium.

Figure 1:
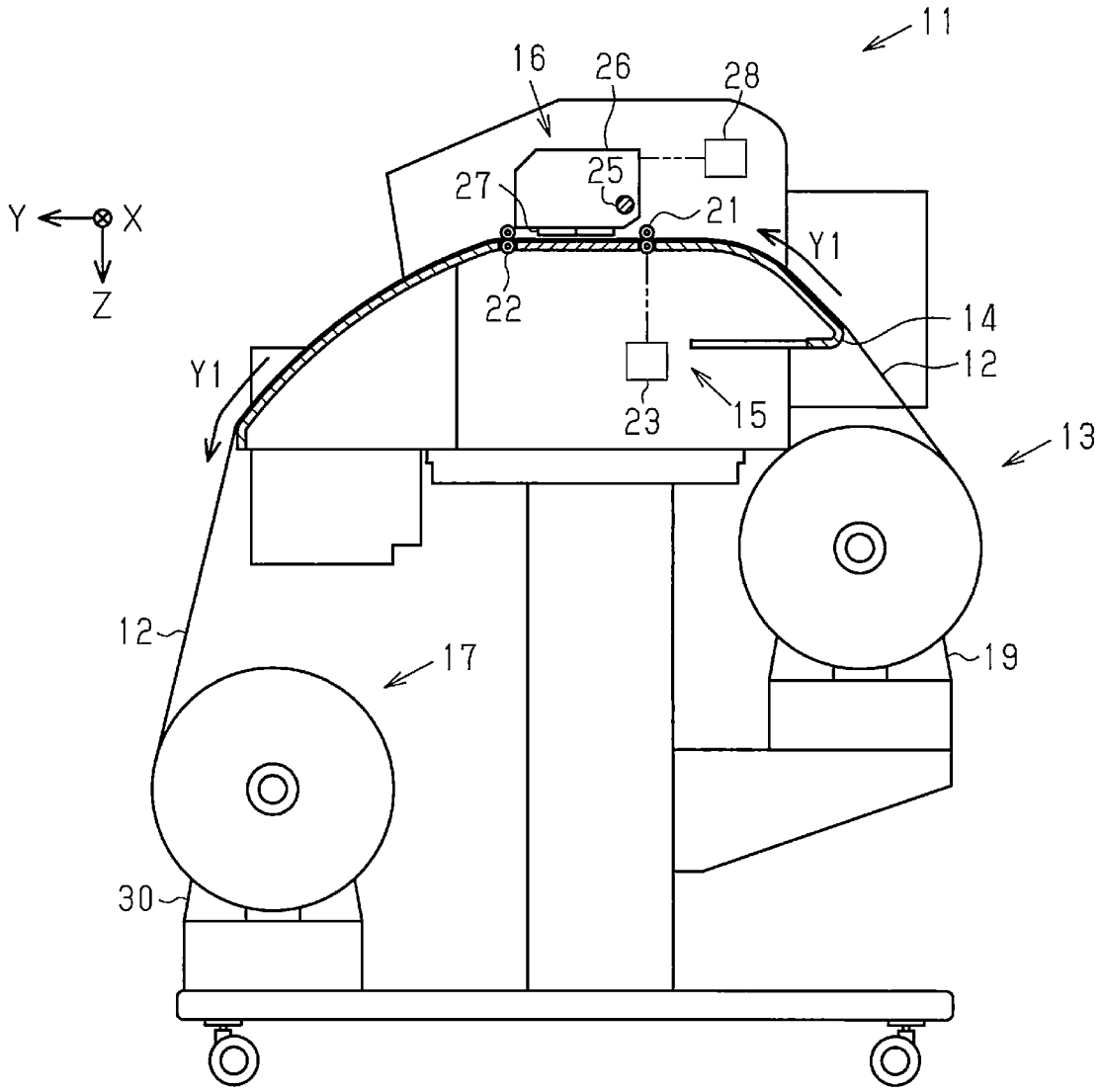
FIG. 1 is a schematic view of a liquid droplet discharging apparatus of an embodiment.

As illustrated in FIG. 1, a liquid droplet discharging apparatus 11 is provided with a feeding unit 13 which feeds a medium 12, a supporting unit 14 which supports the medium 12, a transporting unit 15 which transports the medium 12, a printing unit 16 which performs printing on the medium 12, and a winding unit 17 which winds the medium 12. The liquid droplet discharging apparatus 11 is a serial printer which prints characters, images, and the like by moving the printing unit 16 in a state in which transportation of the medium 12 is stopped, and alternately performs printing and transporting.

In the embodiment, a direction where the printing unit 16 reciprocates is set as a scanning direction, and a direction where the transporting unit 15 transports the medium 12 from the feeding unit 13 positioned on an upstream side to the winding unit 17 positioned on a downstream side is set as a transporting direction Y1. In a printing region where the printing unit 16 performs printing on the medium 12, a direction coinciding with the transporting direction Y1 is set as a depth direction. In the drawings, with an assumption that the liquid droplet discharging apparatus 11 is placed on the horizontal plane, a gravity direction is considered as the height direction and is illustrated along a Z axis, the scanning direction is illustrated along an X axis, and the depth direction is illustrated along a Y axis. The scanning direction and the depth direction are a direction substantially along a horizontal direction. The scanning direction, the depth direction, and the height direction intersect with one another (preferably, orthogonal to one another), and are respectively referred to as directions of a width, a depth, and a height which are represented.

The feeding unit 13 includes a first holding unit 19 which holds the medium 12 wound in a roll shape. The first holding unit 19 is capable of holding a plurality of types of the mediums 12 in which lengths (widths) in the scanning direction, the number of windings, thicknesses, roughness of surfaces, and the like are different. The feeding unit 13 rotates the medium 12 in a roll shape in one direction (counterclockwise direction in FIG. 1), and unwinds and feeds the medium 12.

The transporting unit 15 is provided with a pair of transporting rollers 21 which is provided on an upstream side of the printing unit 16 in the transporting direction Y1, a pair of discharging rollers 22 which is provided on a downstream side of the printing unit 16 in the transporting direction Y1, and a transporting motor 23 which drives the pair of transporting rollers 21 and the pair of discharging rollers 22. The pair of transporting rollers 21 and the pair of discharging rollers 22 rotate in a state of pinching the medium 12 therebetween so as to transport the medium 12. The transporting unit 15 alternately performs transporting and stopping of the medium 12, and intermittently transports the medium 12 in the transporting direction Y1.

The printing unit 16 is provided with a guide shaft 25 in the scanning direction, a carriage 26 supported by the guide shaft 25, a discharging head 27 which discharges liquid droplets such as ink droplets to the medium 12 so as to perform printing, and a carriage motor 28 which moves the carriage 26. A shaft direction of the guide shaft 25 coincides with the scanning direction. The discharging head 27 is held on a lower end of the carriage 26 so as to face the medium 12 supported by the supporting unit 14.

The carriage 26 moves along the guide shaft 25 in accordance with driving of the carriage motor 28. Specifically, when the carriage motor 28 forwardly drives, the carriage 26 and the discharging head 27 moves in a first scanning direction X1 (refer to FIG. 5) distant away from a home position (illustration is omitted). When the carriage motor 28 reversely rotates, the carriage 26 and the discharging head 27 moves toward the home position in a second scanning direction X2 (refer to FIG. 7).

The winding unit 17 includes a second holding unit 30 which holds the medium 12 wound and duplicated in a roll shape. The winding unit 17 rotates the medium 12 in a roll shape in one direction (counterclockwise direction in FIG. 1), and winds the medium 12 which is finished to be printed.

Figure 2:
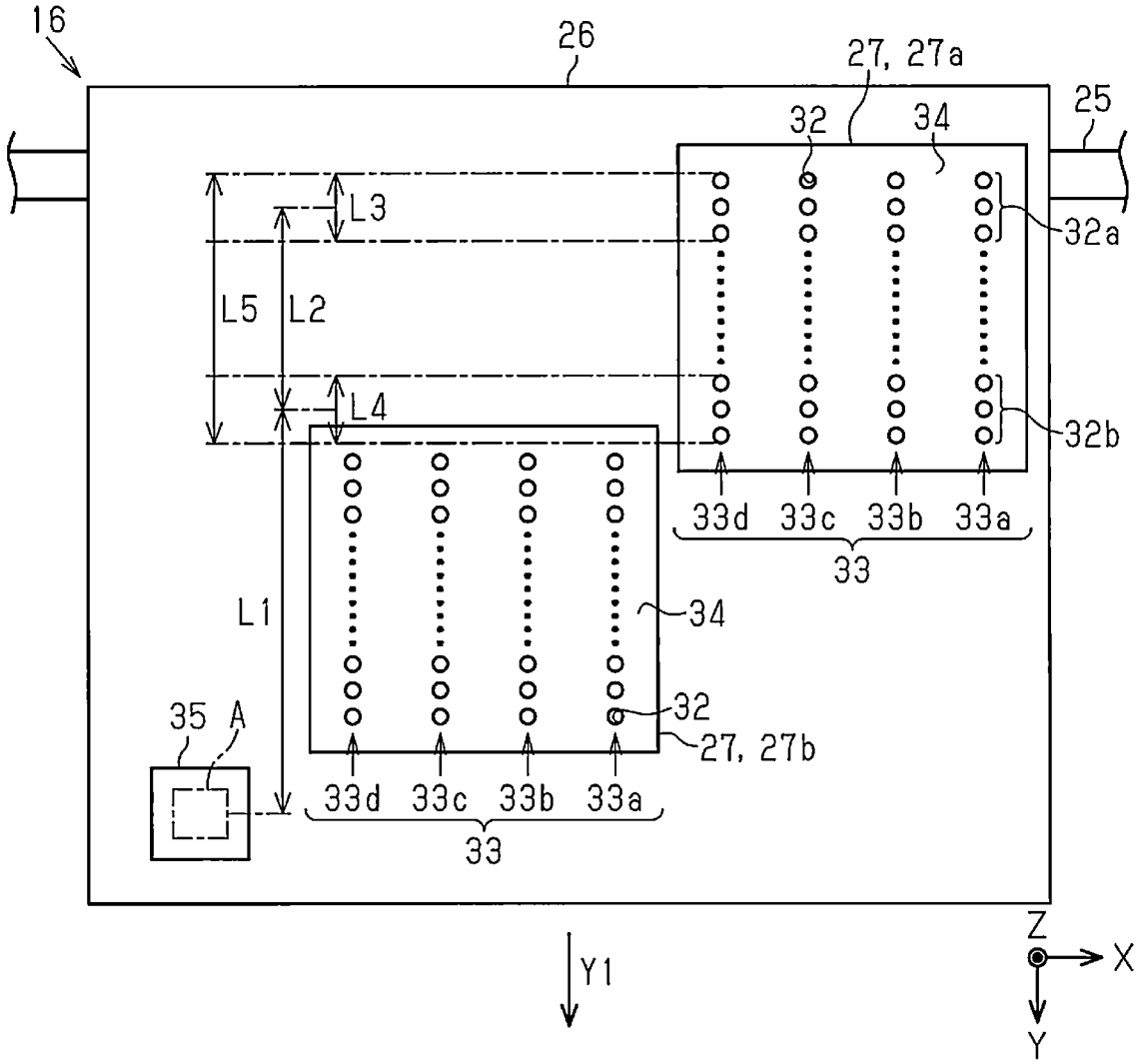
FIG. 2 is a schematic bottom view of a printing unit.

As illustrated in FIG. 2, a plurality (two in this embodiment) of the discharging heads 27 may be provided by deviating a position thereof in the scanning direction and the transporting direction Y1. The first discharging head 27*a* which is positioned on an upstream side in the transporting direction Y1 and the second discharging head 27*b* which is positioned on a downstream side in the transporting direction Y1 have the same configurations as each other and discharge the same type (for example, color) of a liquid droplet. Therefore, in description as follows, the same reference numeral is given to the same configuration, and thus overlapped description will be omitted.

The discharging head 27 includes a nozzle forming surface 34 on which at least one row of nozzle rows 33 in which a plurality of nozzles 32 discharging liquid droplets is arranged is formed (four rows in this embodiment). One nozzle row 33 is configured with the plurality of nozzles 32 arranged in the transporting direction Y1 which is an example of a row direction, and the plurality of nozzles 32 constituting one nozzle row 33 discharge the same type (for example, color) of liquid droplets. A first nozzle row 33*a* to a fourth nozzle row 33*d* are spaced from each other at an interval in the scanning direction.

The liquid droplet discharging apparatus 11 is provided with the reading unit 35 reading an image of the medium 12. The reading unit 35 is held on a lower end of the carriage 26 so as to face the medium 12 supported by the supporting unit 14 (refer to FIG. 1). The reading unit 35 is positioned on a downstream side of the nozzle row 33 of the discharging head 27 (for example, the first discharging head 27*a*) which is used for printing the test pattern 36 (refer to FIG. 4) in the transporting direction Y1. Specifically, a reading region A where the reading unit 35 reads the medium 12 is positioned on a downstream side of the nozzle row 33 of the first discharging head 27*a* in the transporting direction Y1.

The reading unit 35 is, for example, a reflective sensor which detects light reflected by the medium 12, and is capable of detecting a proportion occupied by the printed image in the reading region A. For example, in a case in which an image is printed on the white medium 12 with black ink, reflected light becomes strong as a part where the proportion occupied by the image is small, and reflected light becomes weak as a part where the proportion occupied by the image is large. The reading unit 35 converts the intensity of the reflected light into an electric signal.

The reading unit 35 is provided so as to be capable of changing a position thereof in the transporting direction Y1. The reading unit 35 may be moved by driving a moving mechanism (illustration is omitted) constituted by a cam or the like, using a motor or the like, or may be moved manually by a user.

A part of nozzles among the nozzles 32 positioned on an upstream side in the transporting direction Y1 further than the center of the nozzle row 33 is set as an upstream side nozzle 32*a*. A part of nozzles among the nozzles 32 positioned on a downstream side in the transporting direction Y1 nearer than the center of the nozzle row 33 is set as a downstream side nozzle 32*b*.

In the transporting direction Y1, a first length L1 from the center of the reading region A to the center of the downstream side nozzle 32*b* is an integral multiple of a second length L2 from the center of the upstream side nozzle 32*a* to the center of the downstream side nozzle 32*b*. In the transporting direction Y1, a third length L3 of the upstream side nozzle 32*a* and a fourth length L4 of the downstream side nozzle 32*b* are substantially the same length as each other, and are shorter than a length of a half of the fifth length L5 of the nozzle row 33.

In the embodiment, among the nozzles 32, a quarter part positioned on the most upstream side of the transporting direction Y1 is set as the upstream side nozzle 32*a*, and a quarter part positioned on the most downstream side of the transporting direction Y1 is set as the downstream side nozzle 32*b*. That is, the third length L3 and the fourth length L4 are a quarter of the fifth length L5, and the second length L2 is three-quarter of the fifth length L5. The reading unit 35 is aligned so that the first length L1 becomes twice the second length L2.

Next, an electrical configuration of the liquid droplet discharging apparatus 11 will be described.

Figure 3:
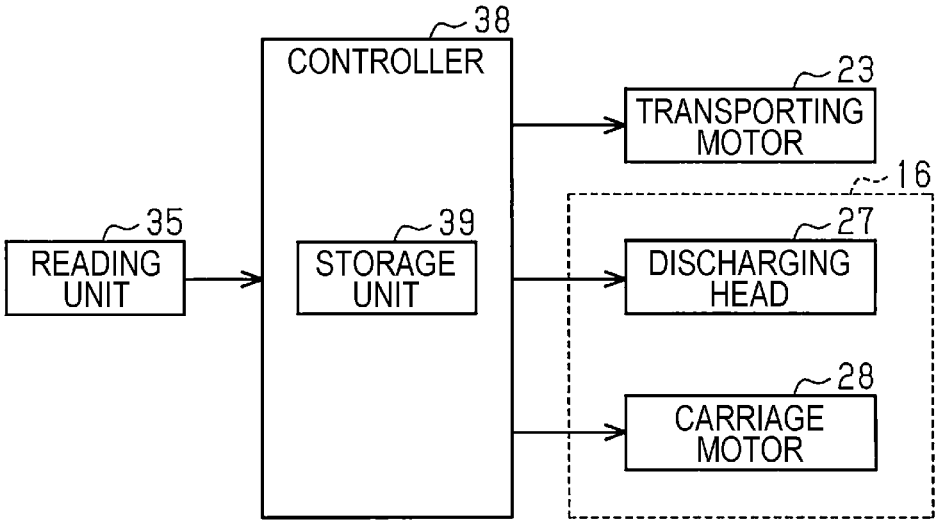
FIG. 3 is a block diagram of the liquid droplet discharging apparatus.

As illustrated in FIG. 3, the liquid droplet discharging apparatus 11 is provided with a controller 38 which integrally controls driving of each mechanism in the liquid droplet discharging apparatus 11. The controller 38 is provided with a storage unit 39 which stores a test program for printing the test pattern 36 (refer to FIG. 4).

The controller 38 drives the discharging head 27 and the carriage motor 28 based on the test program, and the printing unit 16 prints the test pattern 36 by discharging liquid droplets to the medium 12. The reading unit 35 reads the test pattern 36. The controller 38 controls a transporting motor 23, a discharging head 27, and a carriage motor 28 based on information obtained when the reading unit 35 reads the printed test pattern 36, and prints an image or the like on the medium 12.

Next, the test pattern 36 will be described.

Figure 4:
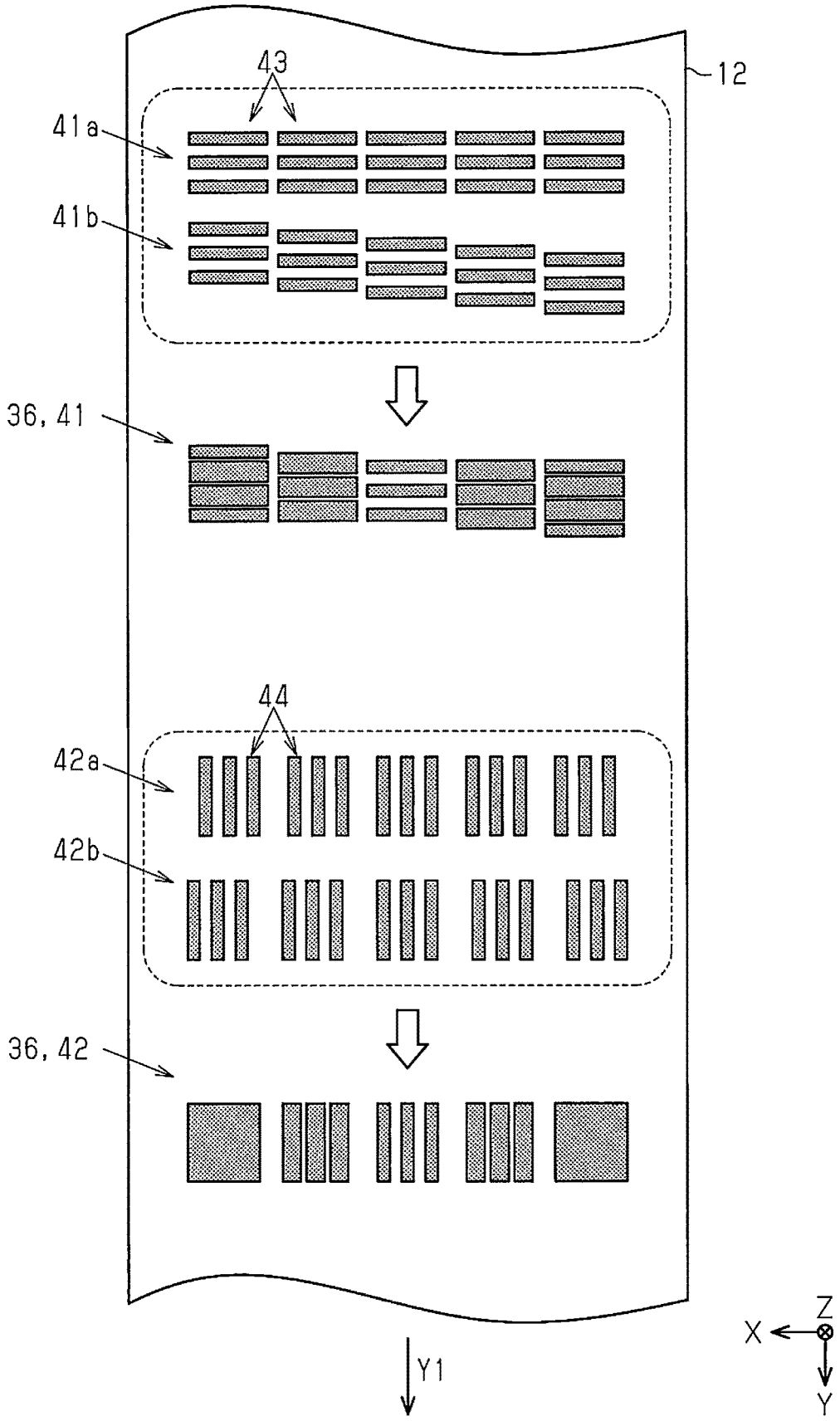
FIG. 4 is a schematic view of test patterns.

As illustrated in FIG. 4, the test pattern 36 is constituted of at least one of a transportation correcting pattern 41 and a position correcting pattern 42 which are an example of a correcting pattern. The printing unit 16 moves the discharging head 27 in the scanning direction which is different from the transporting direction Y1, and prints the test pattern 36 on the medium 12 by discharging liquid droplets from the discharging head 27.

The transportation correcting pattern 41 is a pattern for correcting a transportation amount of the transporting unit 15 which intermittently transports the medium 12 per transportation. The transportation correcting pattern 41 is made by overlapping a transportation reference pattern 41*a* which is an example of the reference pattern with a transportation deviation pattern 41*b* which is a deviation pattern.

The transportation reference pattern 41*a* and the transportation deviation pattern 41*b* are constituted of a transportation basic patterns 43 in which a plurality (three in FIG. 4) of belt-shaped patterns elongated in the scanning direction is arranged in the transporting direction Y1. The transportation reference pattern 41*a* includes a plurality of (five in FIG. 4) the transportation basic patterns 43 which is arranged at equal intervals in the scanning direction at a position same as the transporting direction Y1. The transportation deviation pattern 41*b* includes the plurality (five in FIG. 4) of transportation basic patterns 43 which is arranged at equal intervals in the scanning direction at a different position in the transporting direction Y1. That is, the transportation deviation pattern 41*b* is a pattern to be printed by being deviated with respect to the transportation reference pattern 41*a*. The printing unit 16 prints the transportation deviation pattern 41*b* in an overlapping manner on a region in which the transportation reference pattern 41*a* is printed.

The position correcting pattern 42 is a pattern for correcting a position to which liquid droplets are discharged from the nozzle 32. The position correcting pattern 42 is constituted of a position reference pattern 42*a* which is an example of the reference pattern, and a position deviation pattern 42*b* which is an example of the deviation pattern in an overlapping manner.

The position reference pattern 42*a* and the position deviation pattern 42*b* are constituted of position basic patterns 44 in which a plurality (three in FIG. 4) of belt-shaped patterns elongated in the transporting direction Y1 is arranged in the scanning direction. The position reference pattern 42*a* includes a plurality (five in FIG. 4) of the position basic patterns 44 which is arranged at equal intervals in the scanning direction at a position same as the transporting direction Y1. The position deviation pattern 42*b* includes the plurality (five in FIG. 4) of the position basic patterns 44 which is arranged at equal intervals which are intervals different from the position reference pattern 42*a* in the scanning direction at the position same as the transporting direction Y1. That is, the position deviation pattern 42*b* is a pattern being printed by being deviated with respect to the position reference pattern 42*a*. Regarding the interval of the position basic pattern 44 in the embodiment, the position deviation pattern 42*b* is greater than the position reference pattern 42*a*. The printing unit 16 prints the position deviation pattern 42*b* in the overlapping manner on a region in which the position reference pattern 42*a* is printed.

Next, regarding an action of the liquid droplet discharging apparatus 11, particularly, a pattern reading method of printing and reading the test pattern 36 will be described.

A transportation amount of the medium 12 by the transporting unit 15 and a position where liquid droplets discharged by the discharging head 27 are attached to the medium 12 vary depending on the types of the medium 12 such as a thickness of the medium 12, slipperiness, strength of elasticity, and a size of the medium 12. Therefore, the controller 38 preferably corrects the transportation amount and a discharging position, in a case in which the types of the medium 12 are changed.

In order to print the test pattern 36, either of the first discharging head 27*a* or the second discharging head 27*b* is used. Hereinafter, a case in which the test pattern 36 is printed on the white medium 12 using the first nozzle row 33*a* discharging black ink in the first discharging head 27*a* will be described. The printing unit 16 prints the test pattern 36 including a plurality of correcting patterns. Specifically, the printing unit 16 prints the test pattern 36 including the transportation correcting pattern 41 which is an example of a first correcting pattern, and the position correcting pattern 42 which is an example of a second correcting pattern.

Figure 5:
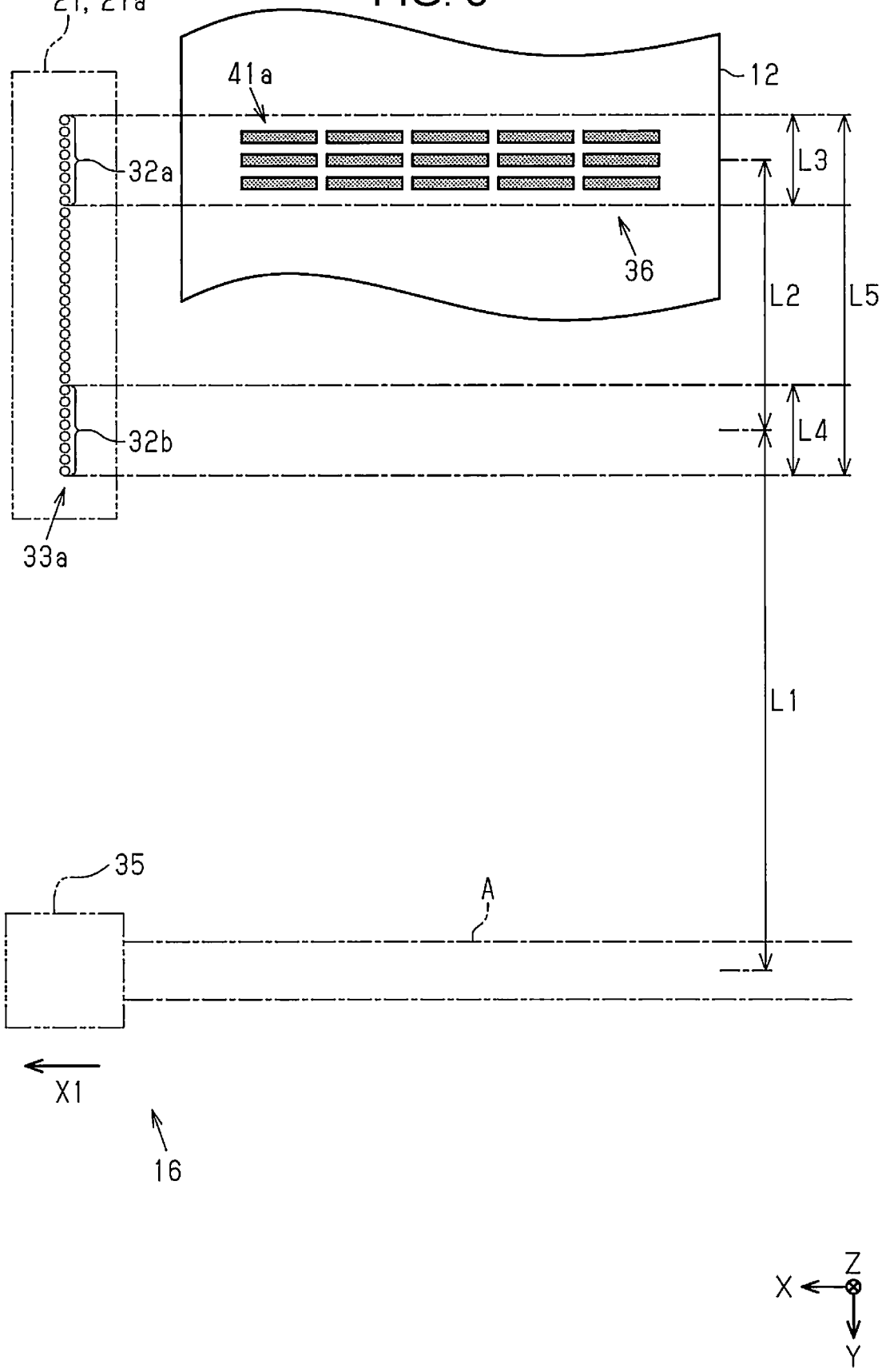
FIG. 5 is a schematic view of a first reference pattern printing process.

As illustrated in FIG. 5, the controller 38 forwardly drives the carriage motor 28 in a state in which driving of the transporting motor 23 stops, and moves the discharging head 27 in the first scanning direction X1. At this time, the printing unit 16 prints the transportation reference pattern 41*a* by discharging liquid droplets from the upstream side nozzle 32*a* to the medium 12 (first reference pattern printing process).

Figure 6:
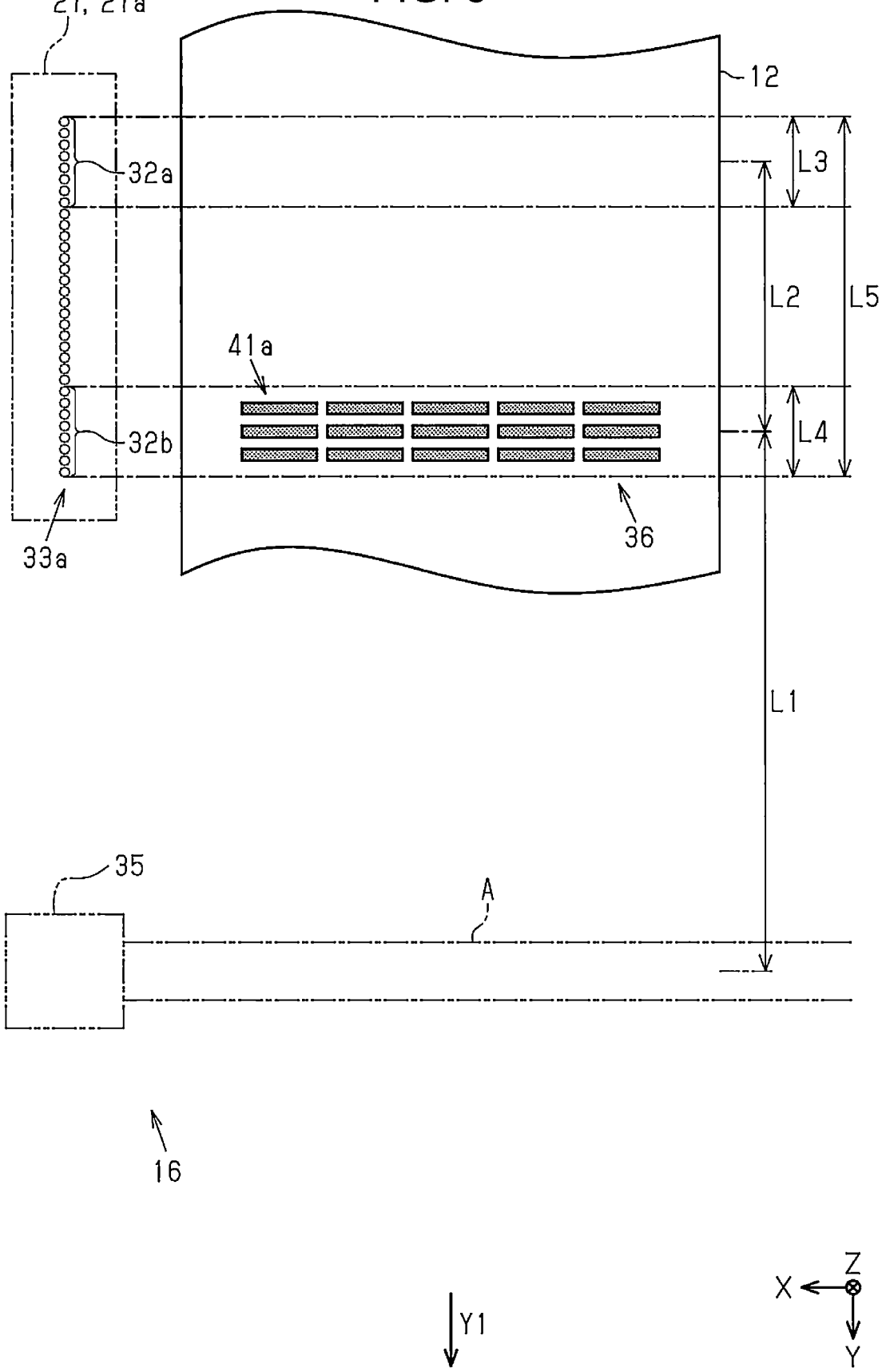
FIG. 6 is a schematic view of a first transporting process.

As illustrated in FIG. 6, when the controller 38 drives the transporting motor 23 and transports the medium 12 by the transportation amount of the medium by the transporting unit 15 per transportation, driving of the transporting motor 23 stops (first transporting process). The transportation amount of the medium per transportation in the embodiment is the same as the second length L2 (three-quarter of fifth length L5). Therefore, in a case in which the medium 12 is transported by an appropriate transportation amount, the center of the transportation reference pattern 41*a* and the center of the downstream side nozzle 32*b* coincide with each other in the transporting direction Y1.

Figure 7:
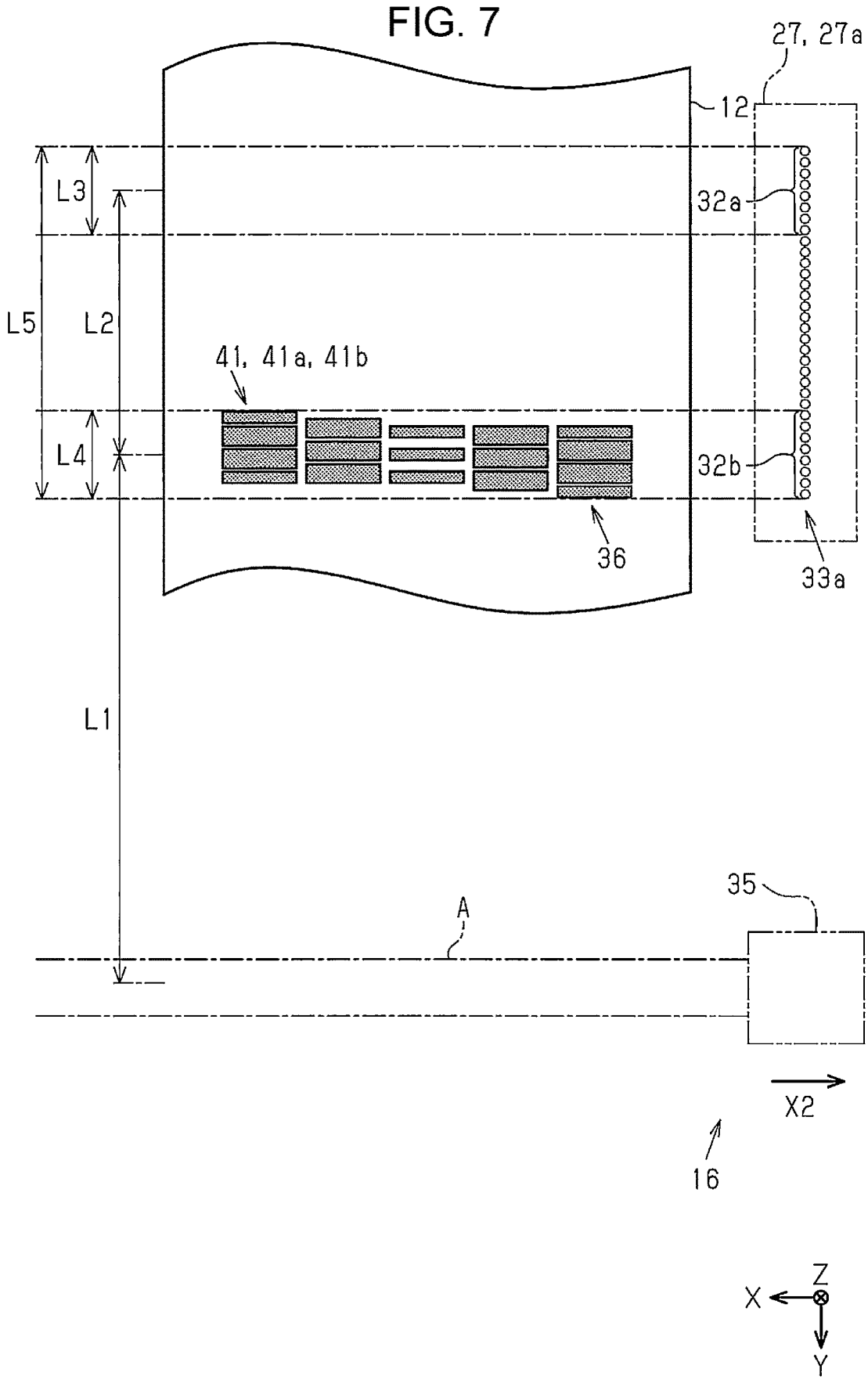
FIG. 7 is a schematic view of a first deviation pattern printing process.

As illustrated in FIG. 7, the controller 38 reversely drives the carriage motor 28 in a state in which driving of the transporting motor 23 stops, and moves the discharging head 27 in the second scanning direction X2. At this time, the printing unit 16 prints the transportation deviation pattern 41*b* by discharging liquid droplets from the downstream side nozzle 32*b* to the medium 12 (first deviation pattern printing process).

In a case in which an actual transportation amount in the first transporting process is the same as a desired transportation amount, the transportation basic patterns 43 positioned at the center in the transportation reference pattern 41*a* and the transportation deviation pattern 41*b* are the same as each other. However, in a case in which there is a difference between an actual transportation amount in the first transporting process and the desired transportation amount, the transportation basic pattern 43 which becomes the same as or smaller than the other transportation basic pattern depending on the difference of the transportation amount.

Figure 8:
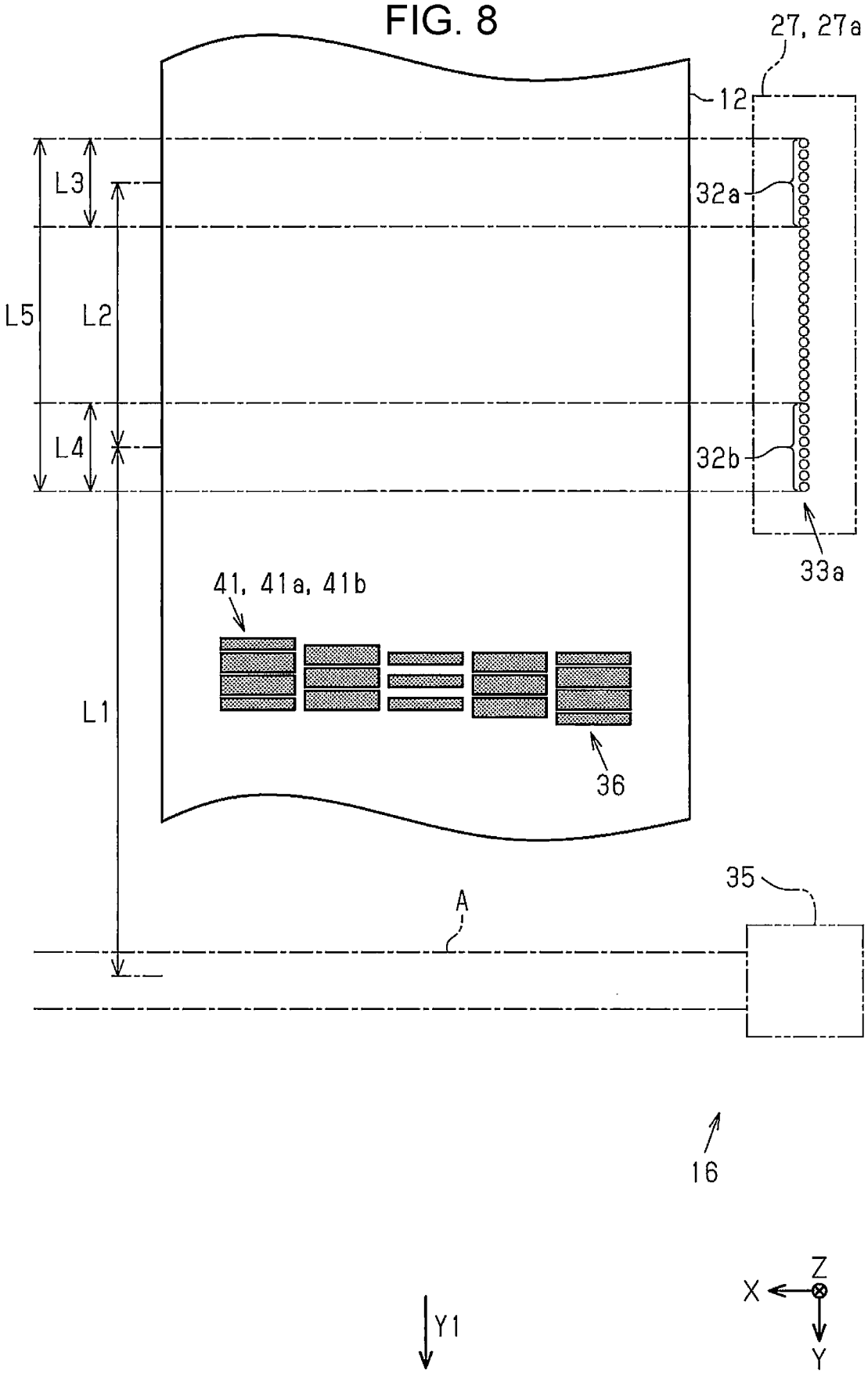
FIG. 8 is a schematic view of a second transporting process.

As illustrated in FIG. 8, when the controller 38 drives the transporting motor 23 and the transporting unit 15 transports the medium 12 by a transportation amount per transportation, driving of the transporting motor 23 stops (second transporting process).

Figure 9:
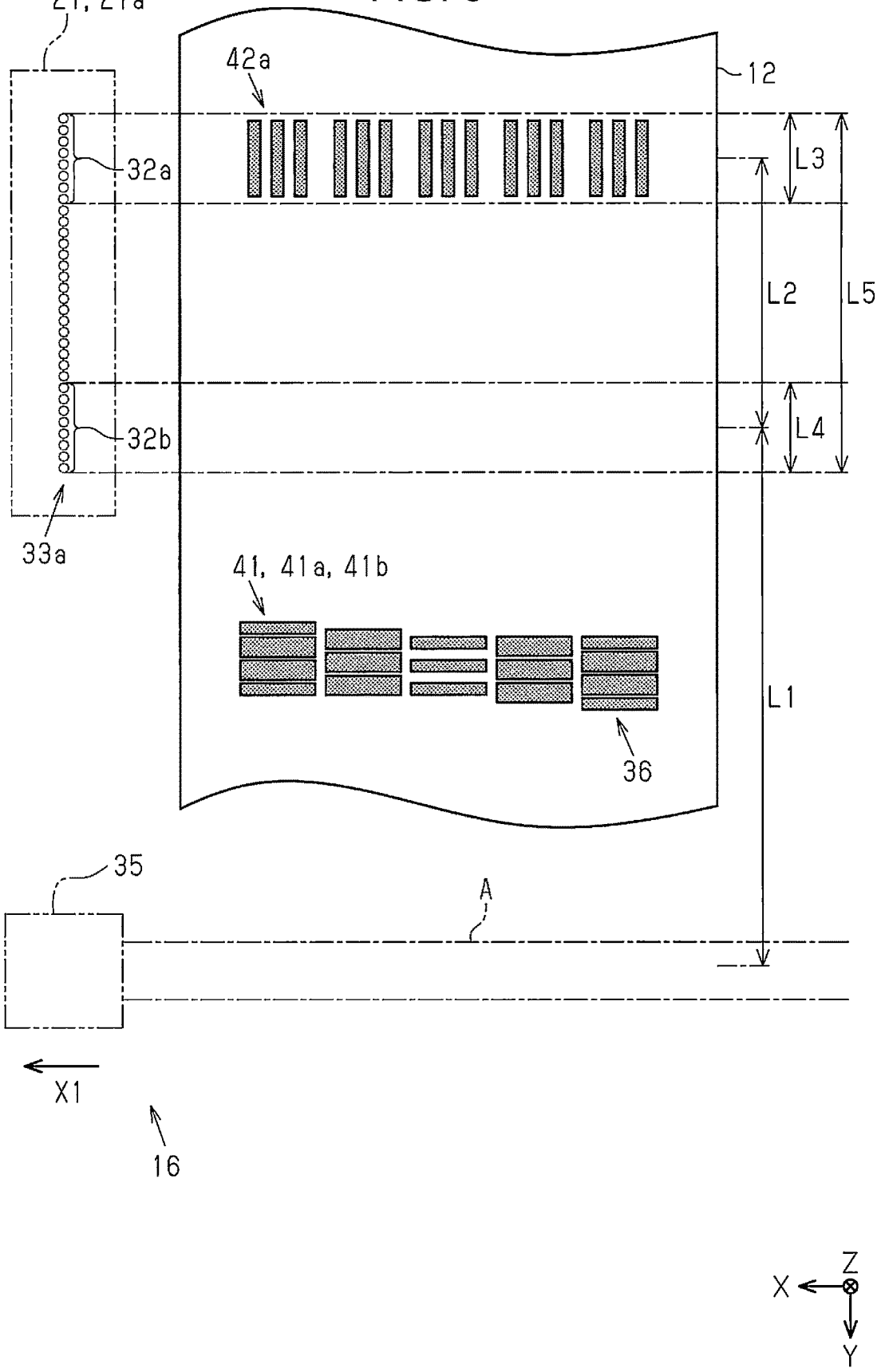
FIG. 9 is a schematic view of a second reference pattern printing process.

As illustrated in FIG. 9, the controller 38 forwardly drives the carriage motor 28 in a state in which the driving of the transporting motor 23 stops, and moves the discharging head 27 in the first scanning direction X1. At this time, the printing unit 16 prints the position reference pattern 42*a* by discharging liquid droplets from the upstream side nozzle 32*a* to the medium 12 (second reference pattern printing process).

Figure 10:
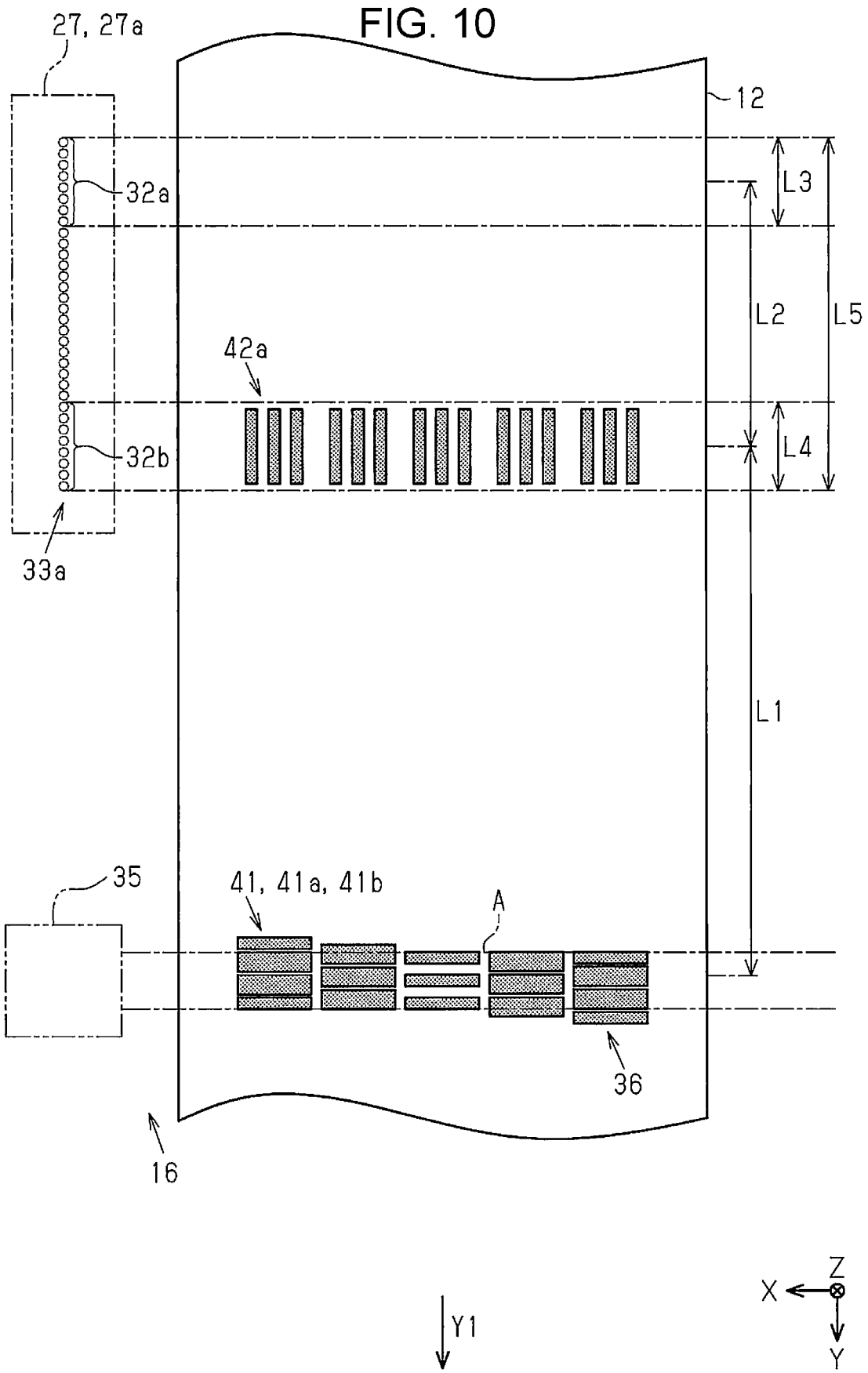
FIG. 10 is a schematic view of a third transporting process.

As illustrated in FIG. 10, when the controller 38 drives the transporting motor 23, and the transporting unit 15 transports the medium 12 by the transportation amount per transportation, the driving of the transporting motor 23 stops (third transporting process). Because of this transportation, the transportation correcting pattern 41 is positioned in the reading region A.

Figure 11:
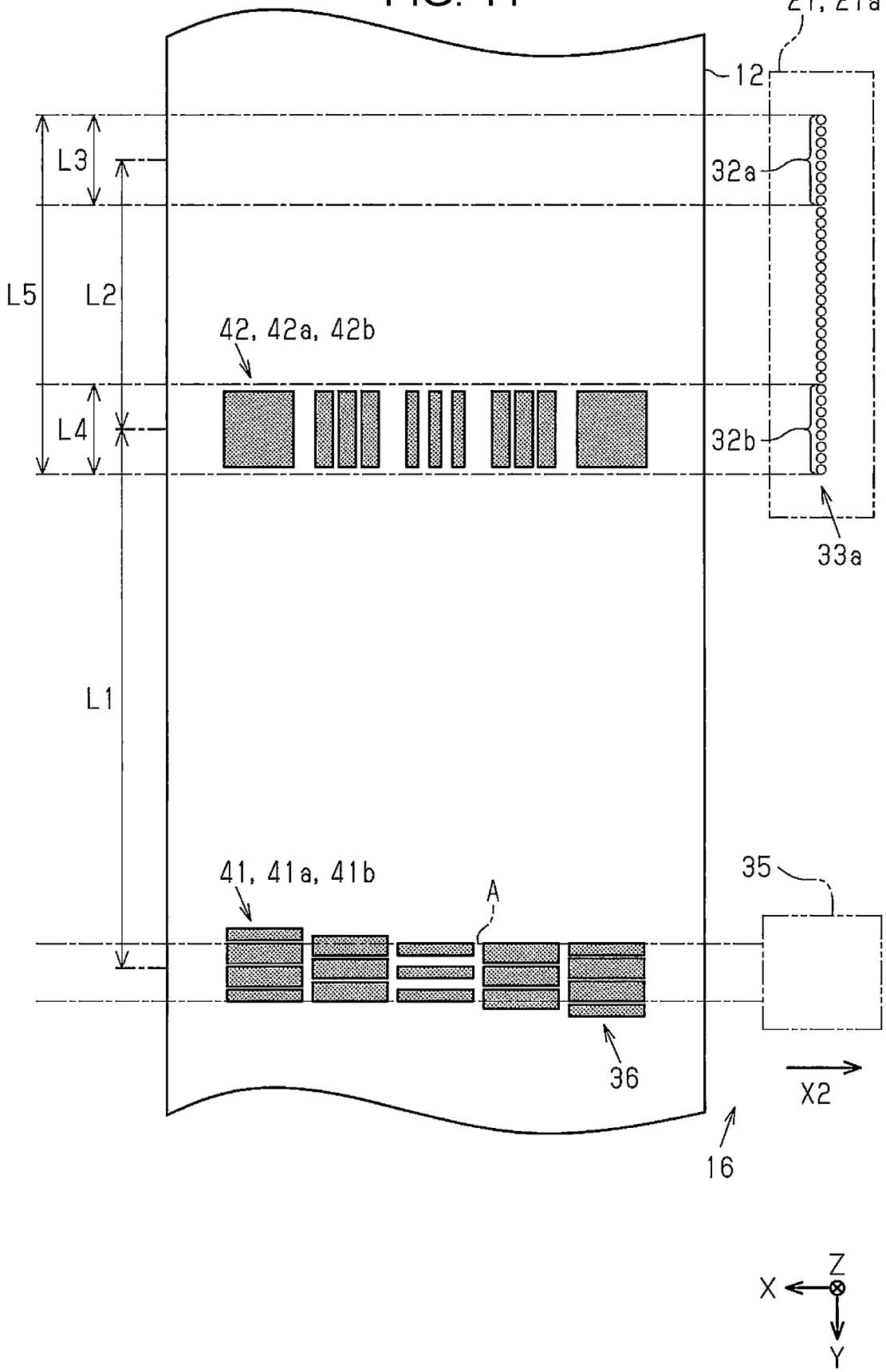
FIG. 11 is a schematic view of a second deviation pattern printing process and a first reading process.

As illustrated in FIG. 11, the controller 38 reversely drives the carriage motor 28 in a state in which the driving of the transporting motor 23 stops, and moves the discharging head 27 in the second scanning direction X2. At this time, the printing unit 16 prints the position deviation pattern 42*b* by discharging liquid droplets from the downstream side nozzle 32*b* to the medium 12 (second deviation pattern printing process). The reading unit 35 reads the transportation correcting pattern 41 positioned in the reading region A (first reading process).

That is, the reading unit 35 reads a completed part of the test pattern 36 at the same time as the printing of the test pattern 36 by the printing unit 16. Specifically, the reading unit 35 reads the transportation correcting pattern 41 at the same time as printing the position correcting pattern 42 by the printing unit 16.

Performing reading and printing at the same time means that the reading unit 35 reads the test pattern 36 from start to finish of printing the test pattern 36 by the printing unit 16. More preferably, the reading unit 35 reads the test pattern 36 from the starting to stopping movement of the discharging head 27 according to discharging liquid droplets in either of the first scanning direction X1 or the second scanning direction X2. The reading unit 35 of the embodiment reads the transportation correcting pattern 41 from starting to stopping movement in the second scanning direction X2, in order to the discharging head 27 prints the position deviation pattern 42*b*.

In a case in which positions at which the discharging head 27 moves and discharges liquid droplets in the first scanning direction X1 and the second scanning direction X2 are matched with each other, the position basic patterns 44 positioned at the center of the position reference pattern 42*a* and the position deviation pattern 42*b* coincide with each other. However, in a case in which a position to which liquid droplets are discharged is deviated, the position basic patterns 44 coincide with each other or vary depending on a deviation amount so as to have a small difference therebetween.

Figure 12:
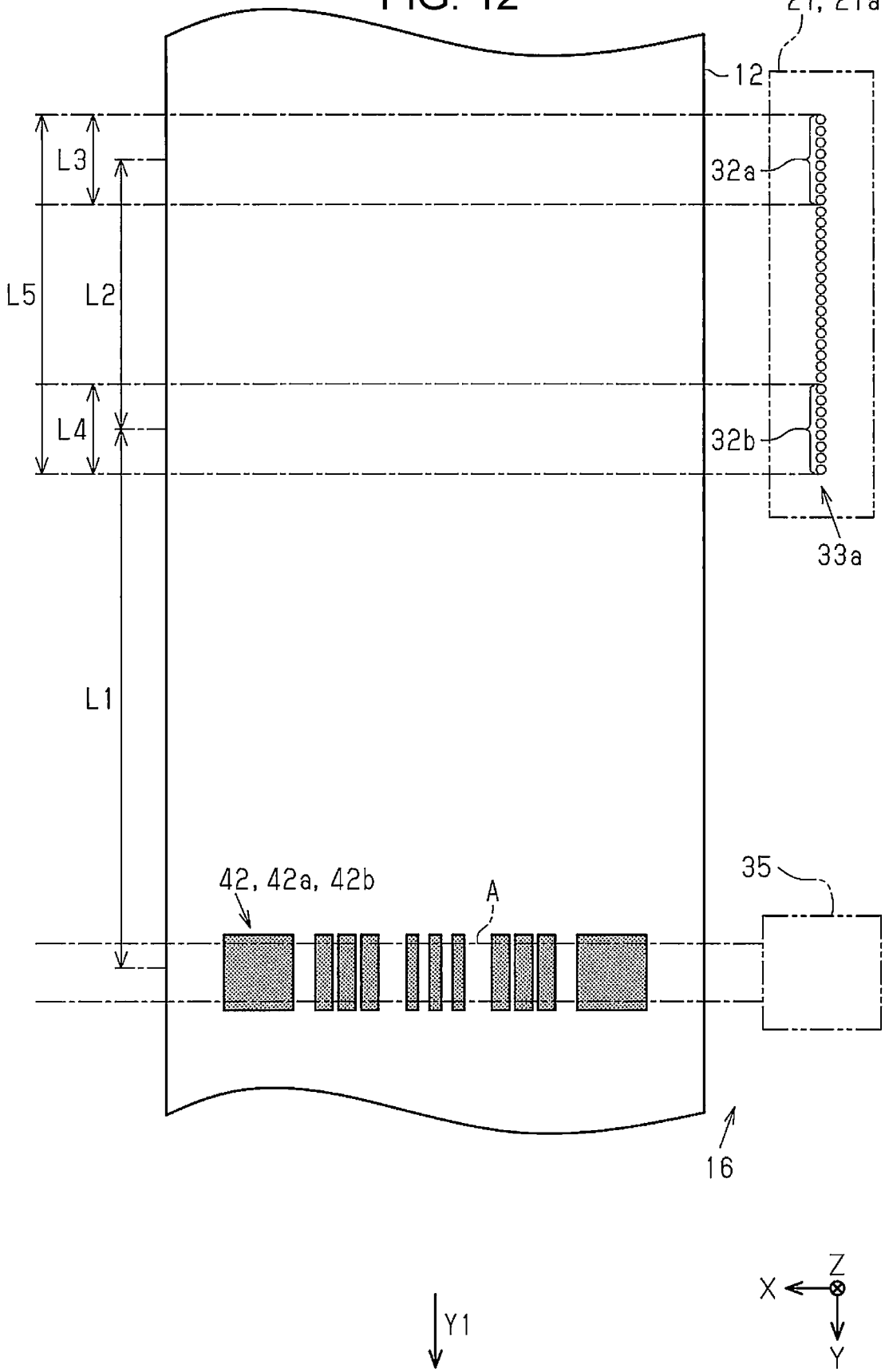
FIG. 12 is a schematic view of a fourth transporting process.

As illustrated in FIG. 12, when the controller 38 drives the transporting motor 23 and the transporting unit 15 transports the medium 12 by a transportation amount per two times of transportation, driving of the transporting motor 23 stops (fourth transporting process). Because of this transportation, the position correcting pattern 42 is positioned in the reading region A.

After that, the controller 38 forwardly drives the carriage motor 28 in a state in which the driving of the transporting motor 23 stops, and moves the discharging head 27 in the first scanning direction X1. At this time, the reading unit 35 reads the position correcting pattern 42 positioned in the reading region A (second reading process).

The controller 38 corrects a transportation amount of the medium 12 per transportation based on the deviation amount of the transportation reference pattern 41*a* and the transportation deviation pattern 41*b* (transportation correcting process). The controller 38 corrects a position to which the discharging head 27 discharges liquid droplets based on the deviation amount of the position reference pattern 42*a* and the position deviation pattern 42*b* (position correcting process). In a case in which an image is printed on the medium 12, the liquid droplet discharging apparatus 11 intermittently transports the medium by the corrected transportation amount, and performs printing by discharging liquid droplets to a corrected discharging position.

That is, the liquid droplet discharging apparatus 11 prints the transportation correcting pattern 41 by a first correcting pattern printing process including the first reference pattern printing process, the first transporting process, and the first deviation pattern printing process. The transporting unit 15 transports the medium 12 from an upstream side to a downstream side in the transporting direction Y1 by the second transporting process while the printing unit 16 prints the transportation correcting pattern 41 and prints the position correcting pattern 42. After that, the liquid droplet discharging apparatus 11 prints the position correcting pattern 42 by a second correcting pattern printing process including the second reference pattern printing process, the third transporting process, and the second deviation pattern printing process.

A printing process includes the first correcting pattern printing process, the second transporting process, and the second correcting pattern printing process, and the printing unit 16 prints the test pattern 36. In the first reading process which is an example of the reading process, the reading unit 35 reads the transportation correcting pattern 41 which is a completed part of the test pattern 36 at the same time as the printing process.

According to the embodiment described above, effects as follows can be obtained.

(1) Since printing of the test pattern 36 by the printing unit 16 and reading of the test pattern 36 by the reading unit 35 are performed at the same time, the test pattern 36 can be quickly read faster than a case in which printing and reading are separately performed.

(2) The test pattern 36 proceeds to be fixed during being transported to the reading region A read by the reading unit 35. Therefore, since the reading unit 35 reads the test pattern 36 which is fixed, accuracy of reading can be improved more than a case in which the test pattern 36 which is immediately printed is read.

(3) The first length L1 from the center of the reading region A which is read by the reading unit 35 to the center of the downstream side nozzle 32*b* is an integral multiple of the second length L2 from the center of the upstream side nozzle 32*a* to the center of the downstream side nozzle 32*b*. Therefore, in a case in which the medium 12 is transported in accordance with the second length L2 from the center of the upstream side nozzle 32*a* to the center of the downstream side nozzle 32*b*, the test pattern 36 is easily positioned in the reading region A.

(4) Since the reading unit 35 is capable of easily changing a position in the transporting direction Y1, for example, even when a transportation amount of the medium 12 varies, the test pattern 36 can be easily positioned in the reading region A.

(5) A position accuracy of the nozzle 32 constituting one nozzle row 33 is higher than a position accuracy of the discharging head 27. The liquid droplet discharging apparatus 11 prints the test pattern 36 using the upstream side nozzle 32*a* and the downstream side nozzle 32*b* constituting the one nozzle row 33. Therefore, for example, a correcting accuracy of the transportation amount and the discharging position by the liquid droplet discharging apparatus 11 can be improved more than a case in which the test pattern 36 is printed using the nozzle 32 of the first discharging head 27*a* and the nozzle 32 of the second discharging head 27*b*.

The embodiment described above may be modified as a modification example as follows. The embodiment described above and modification example as follows may be arbitrarily combined.

The liquid droplet discharging apparatus 11 is provided with a guide rail extending in the scanning direction, and the carriage 26 may move along the guide rail.

The transporting unit 15 may transport the medium 12 by mounting the medium 12 on an endless belt and rotating the belt.

The reading unit 35 may be an imaging element which images the medium 12. The controller 38 may obtain a correction value of the transportation amount or the discharging position by performing an imaging process on the captured image. The controller 38, for example, may print and read grid-shaped test patterns of which rectangles having two of an ink color and a color of the medium 12 are alternately positioned in the scanning direction and the transporting direction Y1, and obtain both correction values of the transportation amount and the discharging position.

An appropriate interval between the reading unit 35 and the medium 12 and an appropriate interval between the discharging head 27 and the medium 12 may be different. Therefore, installing positions of the discharging head 27 and the reading unit 35 may be different in the height direction.

The upstream side nozzle 32*a* may be used for printing the transportation deviation pattern 41*b* or the position deviation pattern 42*b*, and the downstream side nozzle 32*b* may be used for printing the transportation reference pattern 41*a* or the position reference pattern 42*a*. In this case, the transportation deviation pattern 41*b* and the position deviation pattern 42*b* are an example of the reference pattern, and the transportation reference pattern 41*a* and the position reference pattern 42*a* are an example of the deviation pattern.

The reading unit 35 may be unable to change the position in the transporting direction Y1. The reading unit 35 may be fixed to the carriage 26.

The liquid droplet discharging apparatus 11 may be provided with a line shaped reading unit including the reading region in the scanning direction. The reading unit 35 may be not moved in the scanning direction. The reading unit 35 may be provided at a position different from that of the carriage 26.

The position correcting pattern 42 may be printed using all the nozzles 32 constituting one nozzle row 33. Regarding the position correcting pattern 42, the position reference pattern 42*a* and the position deviation pattern 42*b* may be printed using the same nozzle 32. The liquid droplet discharging apparatus 11 may reciprocate the discharging head 27 in a state in which the medium 12 is not transported, print the position reference pattern 42*a* by moving the discharging head 27 in the first scanning direction X1, and print the position deviation pattern 42*b* by moving the discharging head in the second scanning direction X2.

In the transporting direction Y1, the third length L3 of the upstream side nozzle 32*a* and the fourth length L4 of the downstream side nozzle 32*b* may be arbitrarily changed. For example, the third length L3 of the upstream side nozzle 32*a* and the fourth length L4 of the downstream side nozzle 32*b* may be a half of the fifth length L5 of the nozzle row 33, or may be one third of the length.

The first length L1 from the center of the downstream side nozzle 32*b* to the center of the reading region A may be the same (one time) as the second length L2 from the center of the upstream side nozzle 32*a* to the center of the downstream side nozzle 32*b*. The first length L1 may be three times the second length L2 or more. The first length L1 may not be an integral multiple of the second length L2.

The first deviation pattern printing process and the second reference pattern printing process may be performed together. The printing unit 16 may print the transportation deviation pattern 41*b* using the downstream side nozzle 32*b* of the discharging head 27 moved in the second scanning direction X2, and may print the position reference pattern 42*a* using the upstream side nozzle 32*a*. In a case in which the first length L1 and the second length L2 are the same as each other, the transporting unit 15 transports the medium 12 by the transportation amount per transportation, and the transportation correcting pattern 41 is positioned in the reading region A. In this state, the second deviation pattern printing process and the first reading process may be performed at the same time while the carriage 26 moves in the first scanning direction X1.

The first length L1 may be zero times of the second length L2. The reading unit 35 may be provided at the same position as that of the nozzle row 33 in the transporting direction Y1. That is, in the transporting direction Y1, the reading unit 35 may be disposed so that the center of the downstream side nozzle 32*b* and the center of the reading region A are positioned at the same position as each other. A correcting pattern constituting the test pattern 36 may be one. The reading unit 35 is provided on a rear side of the discharging head 27 which prints a deviation pattern while moving in a moving direction, and reads the test pattern 36 at the time of printing the deviation pattern. Specifically, in a case in which the discharging head 27 prints the deviation pattern (transportation deviation pattern 41*b* or position deviation pattern 42*b*) while moving the first scanning direction X1, the reading unit 35 is provided on a home position side nearer than the discharging head 27. In a case in which the discharging head 27 prints the deviation pattern while moving in the second scanning direction X2, the reading unit 35 is provided on an opposite side to the home position nearer than the discharging head 27.

The test pattern 36 may be either pattern of the transportation correcting pattern 41 or the position correcting pattern 42.

Figure 13:
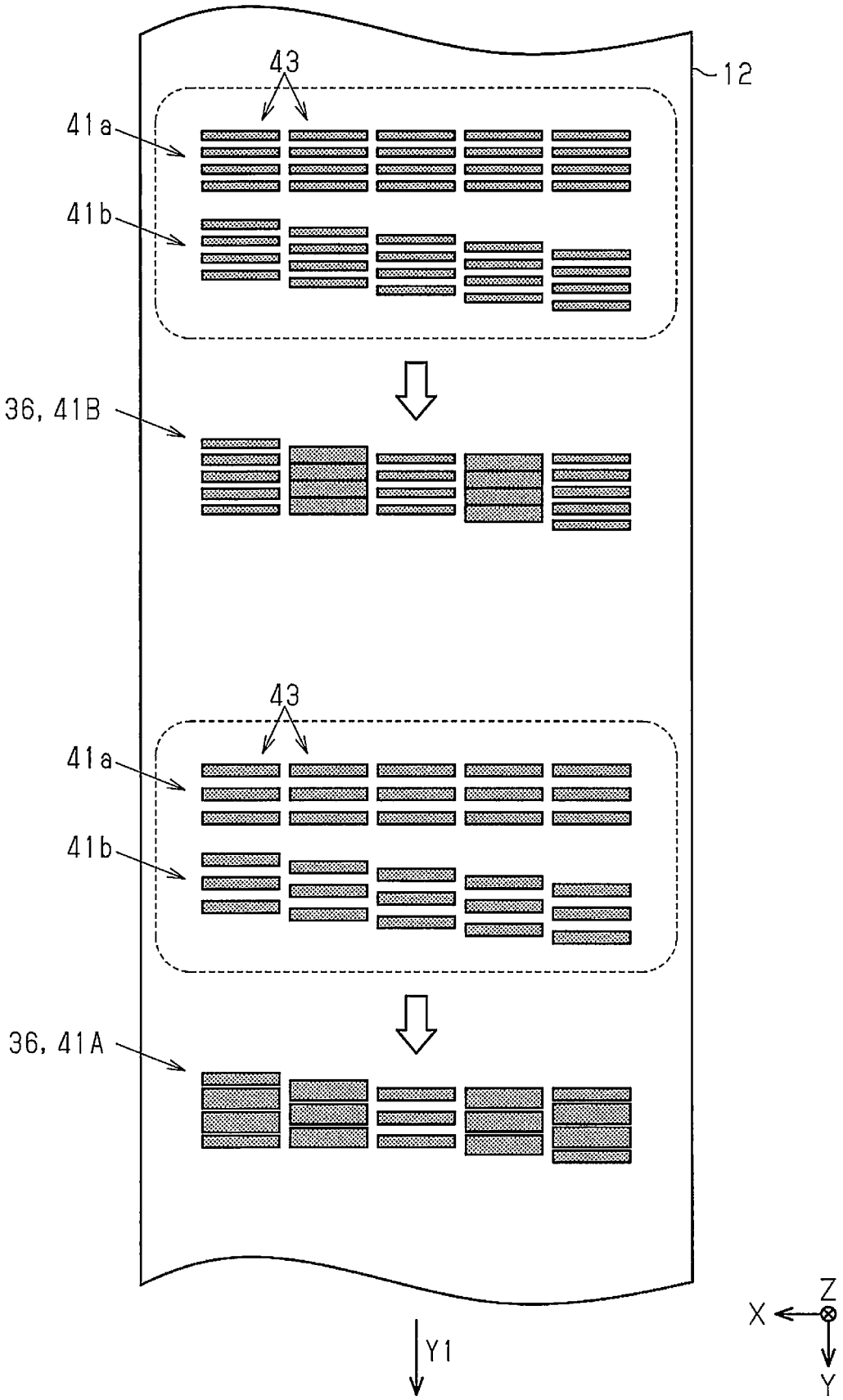
FIG. 13 is a schematic view of test patterns of a first modification example.

As illustrated in FIG. 13, after a first transportation correcting pattern 41A which is an example of the first correcting pattern is printed, the printing unit 16 may print a second transportation correcting pattern 41B which is an example of the second correcting pattern (first modification example). The first transportation correcting pattern 41A and the second transportation correcting pattern 41B may be printed by changing a size, the number, and the like of a pattern constituting the transportation basic pattern 43. For example, the liquid droplet discharging apparatus 11 may print the first transportation correcting pattern 41A with a thick pattern first, and may print the second transportation correcting pattern 41B with a thin pattern at the same time as reading the first transportation correcting pattern 41A. The liquid droplet discharging apparatus 11 may obtain a rough correction value by reading the first transportation correcting pattern 41A, and may obtain a proper correction value by reading the second transportation correcting pattern 41B. The liquid droplet discharging apparatus 11 may print a plurality of position correcting patterns which is patterns having different sizes, and may obtain a proper correction value after the rough correction value is obtained.

The printing unit 16 may print the first position correcting pattern which is an example of the first correcting pattern, and then may print the second position correcting pattern which is an example of the second correcting pattern. For example, the nozzle row 33 used for printing the position correcting pattern 42 may be changed, and a plurality of the position correcting patterns 42 may be printed. That is, for example, the first position correcting pattern may be printed using the first nozzle row 33*a*, and the second position correcting pattern may be printed using the second nozzle row 33*b*. The third position correcting pattern may be printed using the third nozzle row 33*c*, and the fourth position correcting pattern may be printed using the fourth nozzle row 33*d*. The reading unit 35 reads the first position correcting pattern at the same time as printing any one of position correcting pattern among the second position correcting pattern to the fourth position correcting pattern.

The liquid discharged by the discharging head 27 is not limited to ink, and for example, may be a liquid phase body in which particles of a functional material are dispersed or mixed in liquid may be used. For example, the discharging head discharges the liquid phase body including a material such as an electrode material or a coloring material (pixel material) used for manufacturing a liquid crystal display, an electroluminescence (EL) display, a surface emitting display, and the like in a dispersed form or a dissolved form.

The medium 12 is not limited to paper, but may be a plastic film, a thin plate material, or the like, or may be a cloth used for a textile printing apparatus. The medium 12 may be clothing having an arbitrary shape such as T-shirt, or may be a solid object having an arbitrary shape such as tableware or stationery.

The liquid droplet discharging apparatus 11 may be a lateral type printer having the discharging head moving in the scanning direction and the transporting direction Y1.

This application claims priority under 35 U.S.C. § 119 to Japanese Patent Application No. 2017-057139, filed Mar. 23, 2017. The entire disclosure of Japanese Patent Application No. 2017-057139 is hereby incorporated herein by reference.

What is claimed is:

1. A liquid droplet discharging apparatus comprising:

a printing unit configured to:

move a discharging head in a scanning direction, the discharging head comprising a nozzle row in which a plurality of nozzles configured to discharge liquid droplets are arranged, the nozzles being arranged in a row direction that is different from the scanning direction, and print a test pattern on a medium by discharging the liquid droplets from the discharging head;

a transporting unit configured to intermittently transport the medium in a transporting direction that is different from the scanning direction; and a reading unit configured to read the test pattern, wherein the printing unit is configured to print the test pattern by overlapping a reference pattern and a deviation pattern deviated with respect to the reference pattern, in order to correct at least any one of (i) a transportation amount of the medium being intermittently transported by the transporting unit per transportation, and (ii) a discharging position to which the liquid droplets are discharged from the nozzles, and wherein the reading unit is configured to read a completed part of the test pattern at the same time during which the test pattern is printed by the printing unit, wherein the printing unit is configured to print the reference pattern by discharging the liquid droplets from a part of an upstream side nozzle positioned on an upstream side in the transporting direction among the nozzles, wherein the printing unit is configured to print the deviation pattern by discharging the liquid droplets from a part of a downstream side nozzle positioned on a downstream side in the transporting direction among the nozzles, and wherein a first length from a center of a reading region where the reading unit reads the medium to a center of the downstream side nozzle is an integral multiple of a second length from a center of the upstream side nozzle to the center of the downstream side nozzle in the transporting direction.

2. The liquid droplet discharging apparatus according to claim 1, wherein the test pattern includes a plurality of correcting patterns in which the reference pattern and the deviation pattern are overlapped with each other, the plurality of correcting patterns including a first correcting pattern and a second correcting pattern, wherein the transporting unit is configured to transport the medium from an upstream side to a downstream side in the transporting direction after the printing unit prints the first correcting pattern and before the printing unit prints the second correcting pattern, and wherein the reading unit is positioned on the downstream side of the nozzle row in the transporting direction, and is configured to read the first correcting pattern at the same time during which the second correcting pattern is printed by the printing unit.

3. The liquid droplet discharging apparatus according to claim 1, wherein a position of the reading unit is changeable in the transporting direction.

4. A pattern reading method for a liquid droplet discharging apparatus that comprises a printing unit configured to move a discharging head in a scanning direction, the discharging head comprising a nozzle row in which a plurality of nozzles configured to discharge liquid droplets are arranged, the nozzles being arranged in a row direction that is different from the scanning direction, and to print a test pattern on a medium by discharging the liquid droplets from the discharging head, a transporting unit configured to intermittently transport the medium in a transporting direction that is different from the scanning direction, and a reading unit configured to read the test pattern, the method comprising:

causing the printing unit to print the test pattern by overlapping a reference pattern and a deviation pattern deviated with respect to the reference pattern, in order to correct at least any one of (i) a transportation amount of the medium being intermittently transported by the transporting unit per transportation, and (ii) a discharging position to which the liquid droplets are discharged from the nozzles; and causing the reading unit to read a completed part of the test pattern at the same time during which the test pattern is printed by the printing unit, wherein the printing unit is caused to print the reference pattern by discharging the liquid droplets from a part of an upstream side nozzle positioned on an upstream side in the transporting direction among the nozzles, wherein the printing unit is caused to print the deviation pattern by discharging the liquid droplets from a part of a downstream side nozzle positioned on a downstream side in the transporting direction among the nozzles, and wherein a first length from a center of a reading region where the reading unit reads the medium to a center of the downstream side nozzle is an integral multiple of a second length from a center of the upstream side nozzle to the center of the downstream side nozzle in the transporting direction.

* * * * *